United States Patent [19]

Shea

[11] Patent Number: 4,780,172

[45] Date of Patent: Oct. 25, 1988

[54] TAPE DISPENSER

[76] Inventor: Thomas M. Shea, 1865 Harvest La., Bloomfield Hills, Mich. 48013

[21] Appl. No.: 534

[22] Filed: Jan. 5, 1987

[51] Int. Cl.[4] ..... B32B 35/00; B32B 31/18

[52] U.S. Cl. ..... 156/527; 156/577; 156/579

[58] Field of Search ..... 156/523, 527, 574, 577, 156/579; 221/73; 225/39, 47; 242/55.2, 55.53

[56] References Cited

U.S. PATENT DOCUMENTS

| | | | |
|---|---|---|---|
| 2,423,962 | 7/1947 | Clark et al. | 156/577 |
| 2,636,691 | 4/1953 | Fritzinger | 242/55.2 |
| 2,722,331 | 11/1955 | Vogt | 156/527 |
| 3,156,603 | 11/1964 | Robinson | 156/577 |
| 3,542,628 | 11/1970 | Fink, Jr. | 156/527 |
| 3,586,587 | 6/1971 | Boyce | 156/577 |
| 3,902,956 | 9/1975 | Thompson, Jr. | 156/577 |
| 4,060,444 | 11/1977 | Schweig, Jr. | 156/577 |
| 4,357,198 | 11/1982 | Ezquerro | 156/577 |
| 4,453,634 | 6/1984 | Blumenthal | 206/389 |
| 4,591,407 | 5/1986 | Samuelson | 156/527 |

*Primary Examiner*—Michael Wityshyn

*Attorney, Agent, or Firm*—Gifford, Groh, VanOphem, Sheridan, Sprinkle and Dolgorukov

[57] ABSTRACT

An improved tape dispenser includes a housing having parallel spaced sidewalls which have lower edges defining a housing base. The sidewalls may be joined at the top, front and rear of the dispenser but remain open at the lower edges. A resilient tongue extends between a forward portion of the sidewalls and has a portion which protrudes below the lower edges. The protruding end portion has a straight, radiused end for smoothly engaging and applying the tape. A cutting blade is disposed slightly forward and above the end portion of the tongue. Tabs on a rearward surface of the tongue form a guiding slot for the tape and prevent the leading edge from being retracted into the dispenser. Upon drawing the dispenser rearwardly with the lower edges parallel to the surface, the resilience of the tongue causes the radiused end portion to press the tape down to the surface. The tape can be severed, still with one hand, by pivoting the dispenser forwardly about the end portion of the tongue to engage the cutting blade, whereby a simple twist of the dispenser will sever the tape.

3 Claims, 2 Drawing Sheets

TAPE DISPENSER

BACKGROUND OF THE INVENTION

I. Field of the Invention

The present invention relates to a tape dispenser and, in particular, to a tape dispenser having means for applying, pressing and cutting a length of tape with one handed operation.

II. Description of the Prior Art

Tape dispensers of many varieties are already known in the prior art. For example, nearly every household is familiar with the conventional tape dispenser comprising a plastic housing, means for rotatably supporting a roll of tape, and a serrated cutting edge for detaching a length of tape. However, these well known tape dispensers are designed for two handed use, one holding the dispenser while the other pulls and detaches a length of tape. Moreover, applying the tape to a desired surface requires additional handling, which can often result in twisting and mangling of the tape, rendering it useless.

In addition, a few previously known tape dispensers are designed for automatically applying a length of tape to a surface and severing it when the application is completed. U.S. Pat. No. 2,636,691 to G. H. Fritzinger describes such an automatic tape dispenser. Fritzinger's device comprises a housing holding a roll of tape, a handle, an applying member, a cutting edge and various actuating elements. The device is designed to be slid forwardly while a length of the tape is applied and pressed to the desired surface. However, to sever the length of tape, the user must depress a lever or thumbpiece which actuates a mechanism to expose the tape to a cutting edge.

U.S. Pat. No. 4,060,444 to E. S. Schweig, Jr. discloses a similar tape dispenser which requires the pressing of a lever to sever the tape once it is applied. However, Schweig discloses a frangible backed tape rather than a blade as the means for severing.

The previously known, two handed tape dispensers are disadvantaged because they require two hands to operate. Additionally, the second step of applying a detached segment of tape involves the risk of twisting the tape causing it to become stuck to itself. The automatic dispensers partially solve the problem, but still require intricate lever actuating mechanisms which sever the tape. These mechanisms are subject to faulty operation and require additional dexterity to operate.

SUMMARY OF THE PRESENT INVENTION

These and other disadvantages are overcome by the improved tape dispenser of the present invention which comprises a housing including two spaced apart, parallel sidewalls each of which has a lower edge. The lower edges are parallel and they form a base for the housing which lies in a plane perpendicular to the planes of the sidewalls. Although there is no bottom wall, the sidewalls may be connected at their top, front and back by housing portions which span the distance between the two sidewalls. Each sidewall has on its interior face a cylindrical boss for rotatably supporting a roll of tape.

The present invention also has a means for engaging a leading edge from the roll of tape and pressingly applying it to a desired surface. For example, in a preferred embodiment, a tongue is secured to the housing between the sidewalls and has an end portion protruding below the level of the housing base. The tip of the end portion has a straight, radiused edge which smoothly engages an upper surface of the tape to press it into position on a desired surface. In the preferred embodiment, tabs are attached to a rearward face of the tongue. The tabs fold over to define a slot through which the tape passes. The tabs also can releasably engage the underside of the tape to keep the leading edge extended from the dispenser.

A means for cutting, in the form of a serrated blade, is disposed forwardly of the pressing tip of the tongue, and above the plane of the housing base. Once a desired length of tape is applied to the surface, the tape may be severed by pivoting the housing forwardly to engage the cutting means against the tape and twisting the dispenser.

BRIEF DESCRIPTION OF THE DRAWINGS

Other features and advantages of the present invention will be more fully understood by reference to the following detailed description when read in conjunction with the accompanying drawings in which like reference characters refer to like parts throughout the several views and in which.

DETAILED DESCRIPTION OF THE PREFERRED EMBODIMENT

Figure 1:
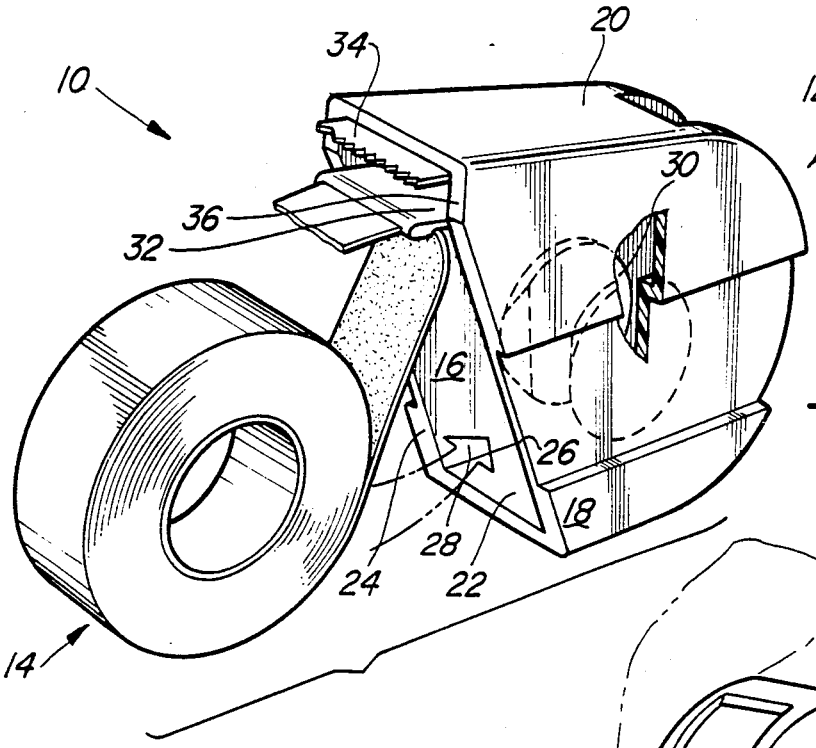
FIG. 1 is an exploded perspective view showing the preferred embodiment of the housing and a roll of tape.
Figure 2:
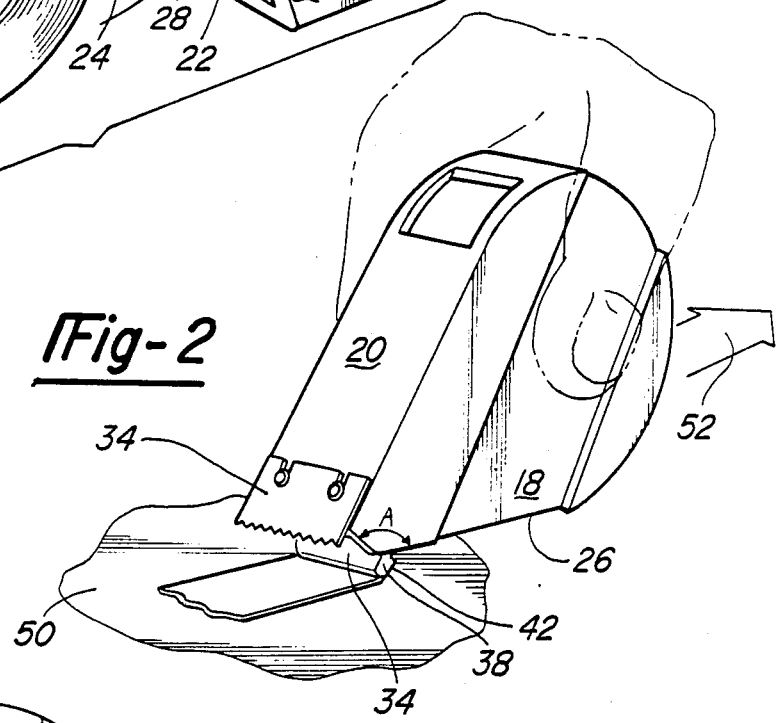
FIG. 2 is a top perspective view of a modified embodiment of the present invention.

Referring first to FIG. 1, the dispenser 10 is thereshown including a housing 12 and a roll of tape 14. The housing 12 comprises a pair of parallel, spaced apart sidewalls 16 and 18 which may be joined together by a top wall 20 or a rear wall 22 or both, but which are not joined at their lower edges 24, 26, thus leaving a bottom opening 28. On the interiors of the sidewalls 16, 18, axially aligned, cylindrical bosses 30 (1 shown) form a support for the roll of tape 14 in a well known manner.

The tape 14 is conventional in composition and dimension and may comprise any of a variety of kinds of tape such as strapping, electrical, cellophane, masking or friction, for example. The sidewalls 16, 18 are dimensioned and spaced to accept standard rolls of such tapes. The use of different types of tapes might require some dimensional changes, but the overall configuration of the dispenser 10 and is operation would remain the same and the dimensions can be obtained by those skilled in the art based on conventional sizes of tape rolls. The lower edges 24 and 26 of the housing 12 are substantially parallel and define a housing base which lies in a plane substantially perpendicular to the sidewalls 16 and 18.

Figure 5:
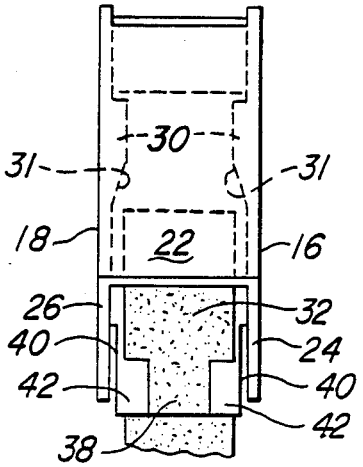
FIG. 5 is a rear plan view.
Figure 6:
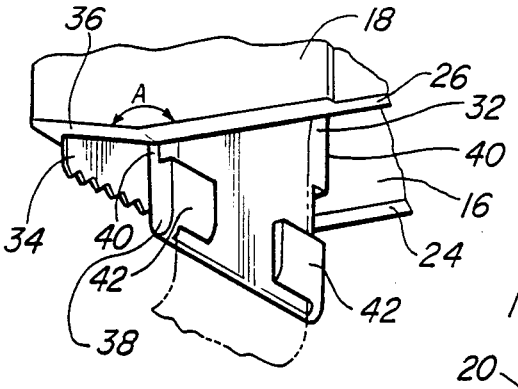
FIG. 6 is a bottom perspective of a portion of the present invention, enlarged for detail.
Figure 7:
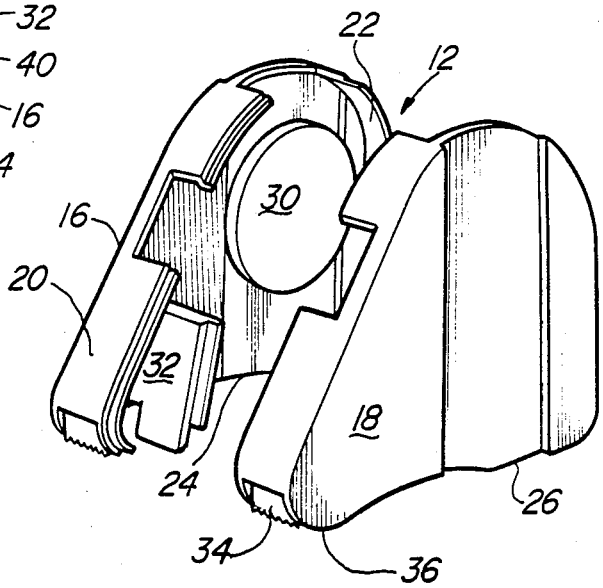
FIG. 7 is a perspective view of another embodiment.

The housing 12 may be constructed of any suitable material, such as molded plastic, and may be constructed in one integral piece, as in FIGS. 1–6, or in two opposing halves as in the embodiment of FIG. 7. If a one piece construction is employed, the housing 12 must be flexible enough to insert a roll of tape 14 through the opening 28 and over the bosses 30. Ideally, the bosses 30 are bevelled as shown at 31 in FIG. 4 to ease insertion of the tape 14. In the two piece construction, the halves are secured together by means of barbed clips, screws, pins and slots, or other fastening means (not shown) known in the art.

Protruding from the housing 12 through a forward portion of the bottom opening 28, is a tongue 32 which spans the sidewalls 16 and 18, and extends below the plane of the housing base. In addition, a serrated cutting blade 34 is disposed in the front portion of the housing 12, forwardly and above the protruding end of the tongue 32.

Referring now to FIG. 7, a slightly different embodiment of the housing 12 is thereshown. Many of the parts of this embodiment correspond to those of the first embodiment and therefore are given the same reference numerals. For example, the housing 12 comprises a pair of spaced, parallel sidewalls 16 and 18 which may be joined by walls at the front 20, top or rear 22 of the housing 12. Each of the sidewalls 16, 18 has a lower edge 24, 26 which define a housing base lying in a plane substantially perpendicular to the sidewalls 16 and 18. A tongue 32 extends between the sidewalls 16, 18 and protrudes below the level of the housing base near the forward portion of the opening 28. Cutting blade 34 is attached to the housing 12 forwardly and above the tongue 32 and preferably is serrated. As best seen in FIG. 5, the cylindrical bosses 30 on the sidewalls 16, 18 extend into the interior of the housing 12 to rotatably support the roll of tape 14.

Figure 3:
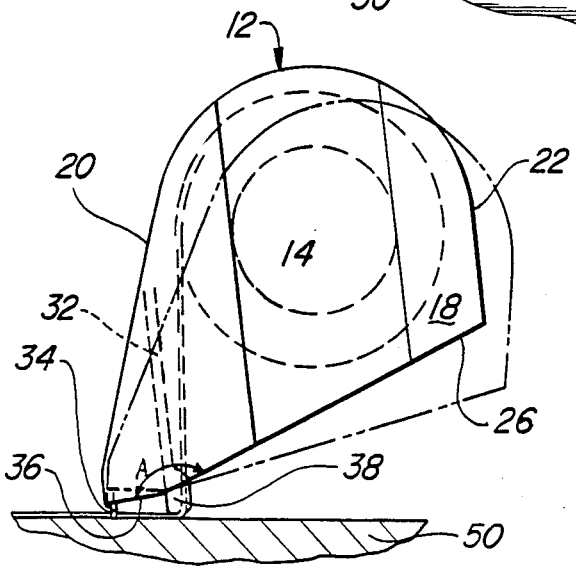
FIG. 3 is a side plan view showing operation of the cutting blade.
Figure 4:
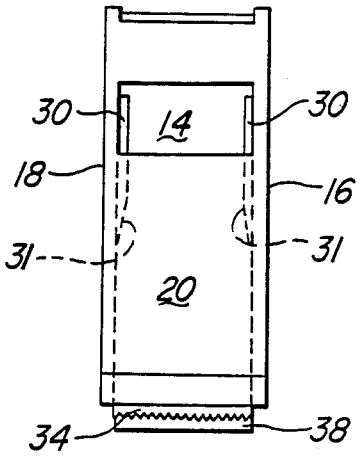
FIG. 4 is a front plan view.

The embodiment of FIG. 7 differs from that of FIGS. 1–6 in the construction of the forward portions of the sidewalls 16, 18 and along the lower edges 24, 26 as well as in having a two piece housing 12. In the embodiment of FIG. 7, the forward portions of the sidewalls 16 and 18 each have rounded or radiused forward base edges 36, while in the other embodiment, the forward portions of the sidewalls 16 and 18 comprises straight forward base edges 36 which form an angle A with the lower edges 24 and 26. As best seen in FIG. 3 and in FIG. 6, angle A is obtuse, preferably about 150° to 165°. In both embodiments, the forward base edge 36 serves to space the cutting blade 34 forward and above the tip of the tongue 32 for proper operation of the dispenser 10.

As best shown in FIGS. 5 and 6, the tongue 32 has a tip or end portion 38 which protrudes below the housing base. The sides 40 of the tongue 32 are substantially parallel to one another and are substantially perpendicular to the end portion 38, so that the tongue 32 is generally rectangular in shape. In cross section, the end portion 38 of the tongue 32 is rounded or radiused as shown in FIGS. 3 and 6, so that the upper surface of the tape 14 will glide smoothly over the end portion 38. In addition, L shaped tabs 42 are attached to the rearward face of the tongue 32 along each side 40. The tabs 42 comprise a spacer portion and a planar surface which is parallel to but spaced apart from the tongue 32. Thus, the tabs 42 form a slot through which the leading edge of the tape 14 is guided. Moreover, the underside of the tape 14 can releasably adhere to the tabs 42 to prevent the leading edge from withdrawing into the housing 12 during use. It is also contemplated that the tabs 42 can extend from one side of the tongue 32 to the other as one continuous planar piece.

The tongue 32 may be mounted rigidly or flexibly in the housing 12. For example, a fairly rigid tongue 32 can be mounted to the housing 12 to provide a firm end portion 38. Alternatively, a rigid tongue 32 can be mounted at its upper end only, leaving its lower end portion 38 free to flexibly move with respect to the sidewalls 16 and 18 or the end portion 38 may be formed of a somewhat resilient material to provide flexibility.

In the preferred form the tongue comprises an elongated generally rectangular member extending substantially in a vertical plane but at an acute angle to the base formed by the edges 22 and 24. The tongue has an upper section extending between the side walls 16 and 18 of the housing a substantial distance above the base.

The tongue further has a lower section (see FIGS. 5 and 6), extending downwardly from the upper section a substantial distance as compared to the vertical extent of the upper section. The lower section is spaced from the sidewalls. The tongue lower section is formed of a flexible material enabling bending movement thereof transversely of the substantially vertical plane of the tongue. The tongue extends downward beneath the base and has a rounded lower end 38 extending laterally of the tongue beneath the base. The cutting means for the tape is supported by the housing and extends downwardly with respect to the sidewalls and to one side of the tongue forward of the tongue.

Preferably, the tongue 32 protrudes through the housing base at the point where the forward base edge 36 begins to turn upwardly. This arrangement contributes to the enhanced operation of the dispenser 10. First, the user inserts a roll of tape 14 into the housing 12, past the beveled edges 31 and over the cylindrical bosses 30. Then a leading edge is extracted from the roll 14 and guided through the slot formed between the tongue 32 and the tabs 42 as shown in FIG. 1. A short portion of the tape 14 is allowed to depend below the end portion 38 of the tongue 32, as shown best in FIG. 6.

Referring again to FIGS. 2 and 3, the user places the dispenser 10 in position on a desired surface 50 with the edges 24 and 26 approximately parallel to the surface 50, and draws the dispenser 10 rearwardly as indicated by the arrow 52, while maintaining downward pressure to keep the end portion 38 of the tongue 32 in contact with the surface. This can conveniently be accomplished with one hand of the user. The rounded tip of end portion 38 protruding below the housing base presses the upper side of the tape 14 against the surface 50. The resiliency of the tongue 32 and the length of the end portion 38 protruding below the housing base determine the magnitude of downward pressure which must be exerted on the dispenser 10 relative to the rearward pressure which unrolls and applies the tape. The user can easily adjust these pressures to operate the dispenser 10.

When a desired length of tape has been applied to a surface 50, the user pivots the dispenser 10 forwardly about end portion 38 so that the cutting blade 34 engages and cuts the tape. In FIG. 3, the housing 12 is shown in solid line in its pivoted position where a simple twisting motion will cause the tape to be severed. The dispenser 10 is then ready to be re-used, having a short length of tape again depending below the tip of end portion 38. The entire application and severing is advantageously accomplished with only one hand, leaving the other free for other purposes, such as holding the surface 50 in a fixed position.

The tabs 42 serve to maintain the tape in close relationship with the tongue 32, and also serve as a surface to which the underside of the tape can releasably adhere in order to keep a leading edge of the tape extended from the roll 14. As the user begins to draw the dispenser rearwardly, as shown at 52 in FIG. 2, the extended portion of the tape catches the surface 50 which, in turn, pulls the tape away from tabs 42 and towards the tongue 32, whereby the rounded end portion 38 pressingly applies the tape to the surface.

The foregoing detailed description of the preferred embodiment has been given for clearness of understanding only and no unnecessary limitations should be understood therefrom. Some modifications will be obvious to those skilled in the art to which the invention pertains, without deviation from the spirit of the invention as defined by the scope of the appended claims.

I claim:

1. A dispenser device for dispensing and applying tape to a surface, said dispenser comprising:

a housing having a pair of spaced sidewalls, said sidewalls having lower edges which define a base for the housing and an open bottom, said sidewalls extending substantially vertically upward from said base and further comprising means for rotatably supporting a roll of tape having a leading edge extending therefrom;

means for engaging the leading edge of said roll of tape, wherein said means for engaging depends from between the sidewalls of said housing and extends below said base through the open bottom, said means for engaging including means for pressing an upper side of the tape against a surface as the tape is being applied;

said means for pressing said tape comprising a tongue, said tongue comprising an elongated rectangular member extending substantially in a vertical plane but at an acute angle to said base and having an upper section extending between said sidewalls of said housing a substantial distance above said base;

said tongue further having a lower section extending downwardly from said upper section a substantial distance as compared to the vertical extent of said upper section, said lower section being spaced from said sidewalls, said tongue lower section being formed of a flexible material enabling bending movement thereof transversely of said substantially vertical plane;

said tongue extending downwardly beneath said base and having a rounded lower end extending laterally thereof beneath said base; and means for cutting the tape, supported by said housing and extending downwardly with respect to said sidewalls to one side of said tongue and having a cutting edge.

2. The dispenser device as defined in claim 1 wherein said housing is formed of at least two portions securable together, each of said portions including one of the sidewalls.

3. The dispenser device as defined in claim 1 wherein each of the sidewalls has a forward sidewall portion with a lower edge defining a forward base edge, and wherein said forward base edges bend upwardly approximately at said lower end portion of said tongue to form an angle of about 150–165 degrees with said base said cutting means extending downward forwardly of said tongue with respect to said sidewalls and having a cutting edge facing downwardly of said forward base edges.

* * * * *